United States Patent [19]

Linn

[11] Patent Number: 4,557,503

[45] Date of Patent: Dec. 10, 1985

[54] BINDING UNIT

[76] Inventor: Maynard W. Linn, 6336 N. Bergeron, Fresno, Calif. 93704

[21] Appl. No.: 630,845

[22] Filed: Jul. 13, 1984

Related U.S. Application Data

[63] Continuation-in-part of Ser. No. 362,021, Mar. 25, 1982, Pat. No. 4,493,495, and a continuation-in-part of Ser. No. 454,320, Dec. 29, 1982, Pat. No. 4,524,992.

[51] Int. Cl.[4] ..... B42D 17/00; A44B 19/02; B42F 15/00

[52] U.S. Cl. ..... 281/47; 24/494; 24/515

[58] Field of Search ..... 281/45, 47; 24/67.5, 24/477, 488, 491, 492, 494, 498, 513, 515, 519, 525; 256/56; 292/342; 412/34

[56] References Cited

U.S. PATENT DOCUMENTS 125,311 4/1872 Lucas ..... 24/515
1,899,982 3/1933 Olson ..... 24/515

*Primary Examiner*—Paul A. Bell
*Assistant Examiner*—Paul M. Heyrana, Sr.
*Attorney, Agent, or Firm*—Don B. Finkelstein

[57] ABSTRACT

A device for binding the marginal edge of materials is provided which takes the form of a continuous section of resilient material. The section of the device includes a pair of legs on which the closing force can be released to allow the acceptance of the materials, a spline around which both of the legs pivot to close over the edge of the materials to hold them securely by the material engaging ends of the legs when a moving means is engaged to produce a closing force. A latch is provided to lock the moving means in a position whereat the legs are closed.

25 Claims, 35 Drawing Figures

FIG. 4A
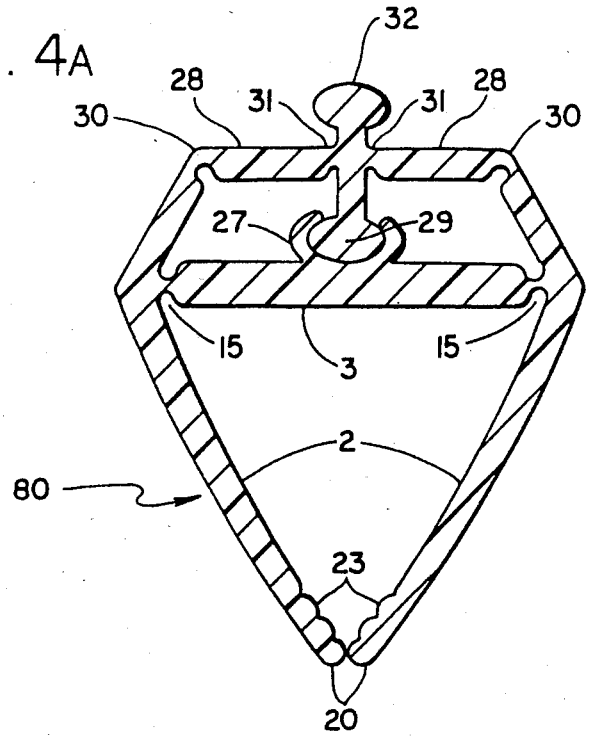
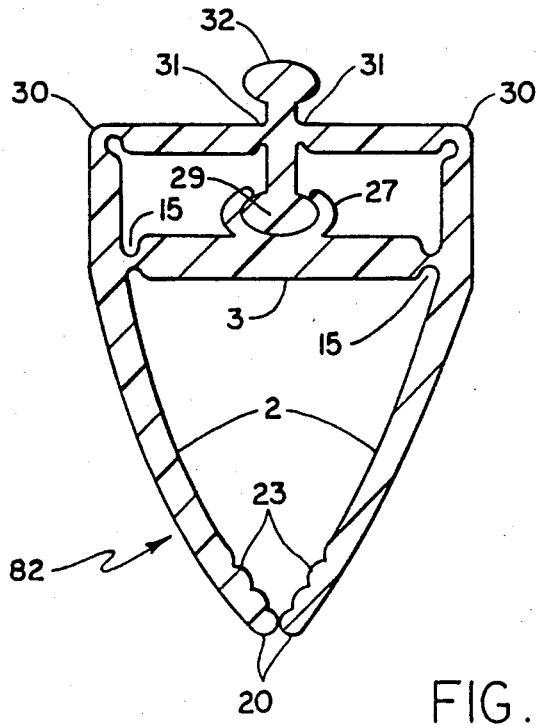
FIG. 4B

FIG. 25
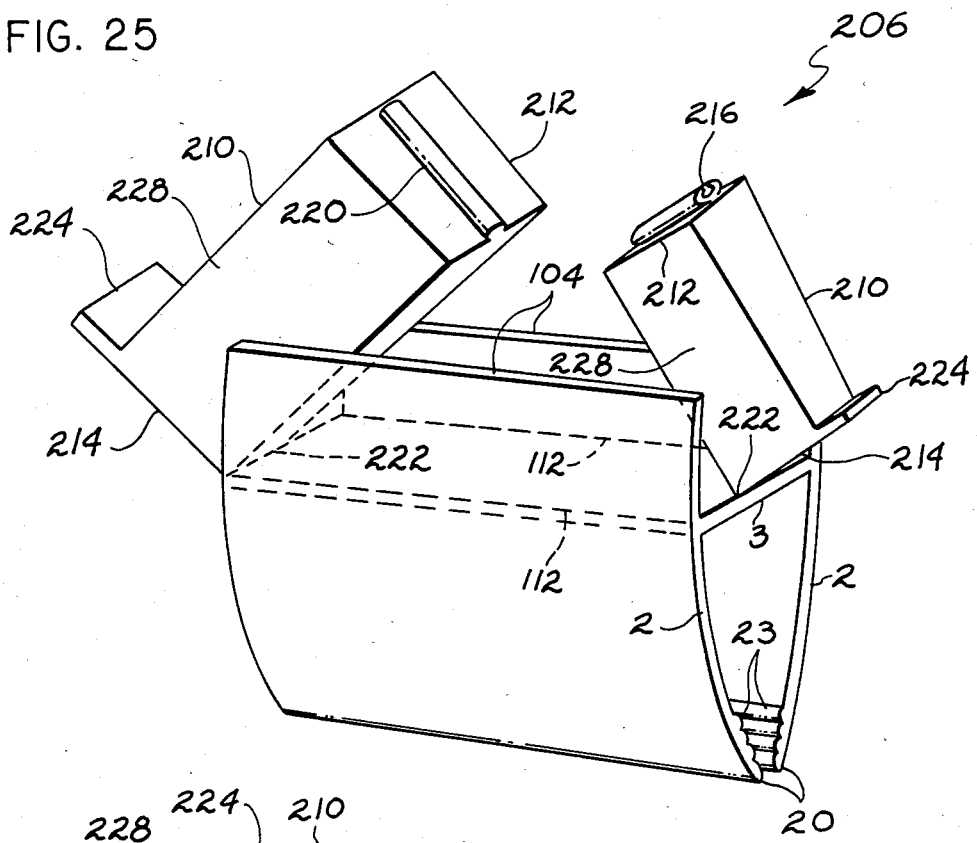
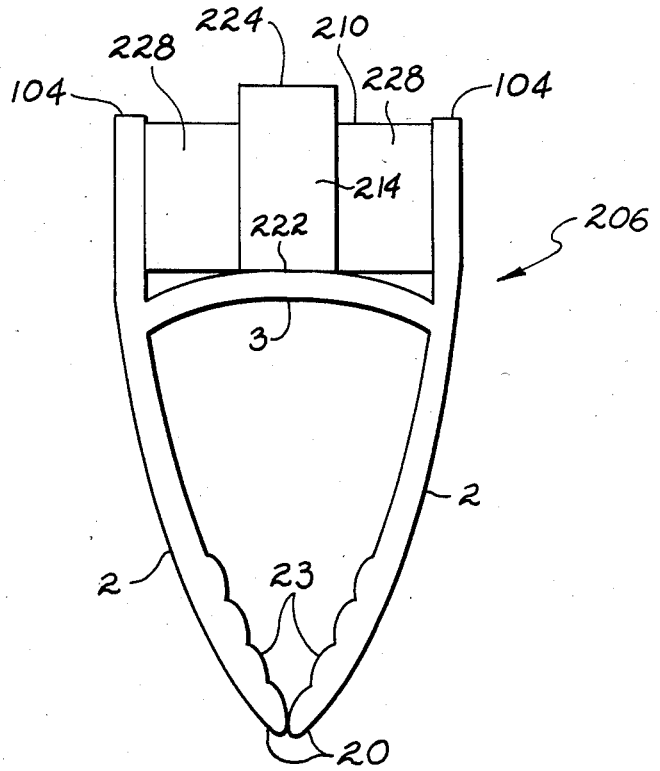
FIG. 26

BINDING UNIT

This application is a continuation-in-part of previously filed U.S. patent application Ser. No. 362,021, filed Mar. 25, 1982, now U.S. Pat. No. 4,493,495, and a previously filed U.S. continuation-in-part patent application, Ser. No. 454,320, filed Dec. 29, 1982, now U.S. Pat. No. 4,524,992 and the teaching and technology contained in each are incorporated herein.

BACKGROUND OF THE INVENTION

1. Field of the Invention

This invention relates generally to a binding and gripping unit for the edge of material, and, more particularly, to an improved binding unit which provides clamping pressure after a stack of material has been inserted into the binding unit, which clamping pressure can be released to allow the removal of the stack of material without damage.

2. Description of the Prior Art

Some prior proposed devices for binding sheet materials have required that each sheet be perforated adjacent one edge margin. If sheets are to be added, deleted or rearranged, the existing sheets must be removed from the device and then reinserted into the device. Often the perforations in the sheets become torn, with the result that a sheet may fall out of the assembled stack.

Other prior devices for binding sheet materials required that the stack of sheets be forced in between the clamping members to grip the inserted stack of papers and hold the sheets bound at the edge. Often this same resiliency causes the clamping members to damage the sheets as they are forced in between the clamping members. As the resiliency must be weak enough to allow the stack to be inserted, it is often weak enough to allow the stack to become dislodged during normal shuffling of the documents.

Certain prior art structures have attempted to alleviate this condition. One such device, as shown in U.S. Pat. No. 3,845,521, shows an adjustable binding unit which allows the gripping edges to be adjusted to accommodate a larger stack of materials. But the material must still be wedged between the gripping edges with the same magnitude of force that will hold the material, resulting in damage to the material if the force is great, or scattering of the material if the force is insufficient to hold the material during normal use.

U.S. Pat. Nos. 586,937; 2,282,565; and 2,869,210, show binding units which open to accept loose-leaf materials without perforations, but are designed for heavy duty applications to display materials, and none are proven to be completely satisfactory for the binding of small reports.

U.S. Pat. Nos. 3,665,563, and 3,698,043 show other binding units which are lightweight and open to accept loose-leaf materials, but are designed to be used in a plurality of units to prepare materials for display. Unless the units are tied together, they will cause portions of the materials to be folded under, with resulting damage to the loose-leaf materials.

SUMMARY OF THE INVENTION

Accordingly, it is the object of the present invention to provide a binding unit for loose-leaf sheets which opens to accept the stack of sheets and then closes around one edge of the stack.

It is another object of the present invention to provide the distinct advantage that the invention does not require perforations in the sheets to hold the sheets securely, nor does the invention require that the sheets be forced between the retaining means. Thus, the sheets can be inserted, taken out, rearranged, and inserted, without damage from the retaining means.

In my above identified, previously filed, U.S. patent application, Ser. No. 362,021, filed Mar. 25, 1982, and now U.S. Pat. No. 4,493,495 the above and other objects of the present invention are achieved, according to a preferred embodiment thereof, by providing a binding unit which has two legs joined together near one end of the legs. The other end of the legs is free, and can be pivotally opened to accept the edge of the material. The free ends are then closed around an edge of a stack of material to clampingly secure the stacked material together. A latch is provided to hold the binding unit in the closed position. The binding unit can be unlatched and the free ends opened to allow the removal of the stack of material without damage.

In my above identified previously filed U.S. patent application, which is a continuation-in-part of the above identified patent application, and bears Ser. No. 454,320, filed on Dec. 29, 1982, the invention achieves the above objects, according to a preferred embodiment thereof, by providing a binding unit which has two legs joined together near one end of one leg and at the end of the other leg. The other end of the legs is free and one leg can be pivotally opened to accept the edge of the material. The free ends are then closed around an edge of a stack of material to clampingly receive the stacked material together. A latch is provided to hold the binding unit in the closed position. The clamping pressure can be adjusted by closing the latch in several positions. The binding unit can be unlatched and the free ends opened to allow the removal of the stack of material without damage.

BRIEF DESCRIPTION OF THE DRAWING

The above and other embodiments of the present invention may be more fully understood from the following detailed description, taken together with the accompanying drawing wherein similar reference characters refer to similar elements throughout and in which:

FIG. 4*a* is a sectional view of another embodiment of the present invention;

FIG. 4*b* is a sectional view of another embodiment of the present invention;

FIG. 25 is a perspective view of another embodiment of the present invention in the open position thereof;

FIG. 26 is an end view of another embodiment of the present invention in the closed position thereof;

DESCRIPTION OF THE PREFERRED EMBODIMENTS

Figure 1:
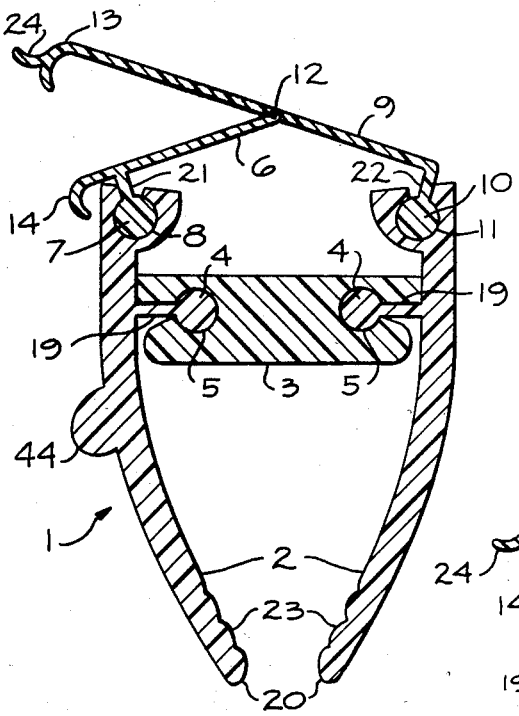
FIG. 1 is a sectional view of an embodiment of a binding unit according to the present invention in the open position thereof.

As described in my above identified U.S. patent application Ser. No. 362,021, filed Mar. 25, 1982, referring now to FIG. 1, the binding unit 1 consists of two legs 2, each hinged to a spline 3 by a ball 4 and socket 5 joint. The ball 4 is made an integral part of the leg 2, being attached to leg 2 by stand off 19, and allows leg 2 to pivot around the end of spline 3. The spline 3 has a socket 5, formed to accept the ball 4 and allow movement of the ball 4 and stand off 19, such that each leg 2 will open and close to its operational limits by this spline hinge without restriction from spline 3. The free edges 20 of the legs 2 are formed with material engaging end portions 23.

The material engaging end portions 23 are shown as a series of ridges. The ridges should have a smooth surface so as not to damage the loose-leaf material, and the size of the ridges should be selected so as not to impress a pattern into the loose-leaf material. The ridges can be designed so that the top of opposing ridges engage each other, or so that the tops of one set of ridges engages the valleys of the other set of ridges.

Figure 2:
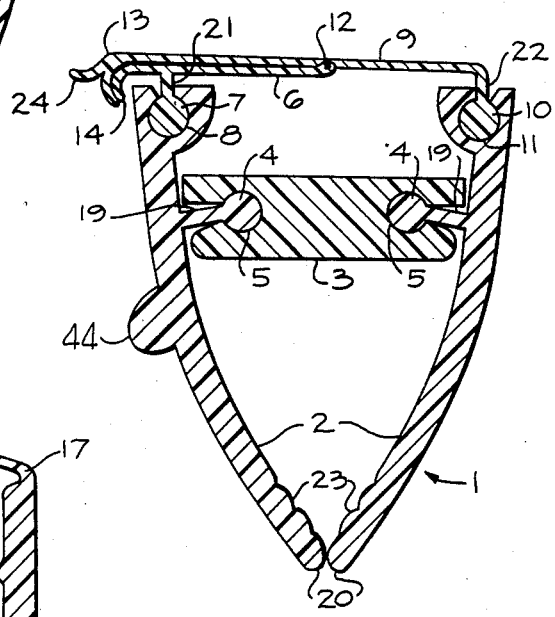
FIG. 2 is a sectional view of the embodiment of FIG. 1 in a closed position.

As can be seen from FIGS. 1 and 2, the members 6 and 9, which provide the moving means to open and close the legs 2, are of preselected length and attached at the ends of the legs 2. The shorter member 6 is hinged to the remote end of one leg 2 by a ball 7 and socket 8 joint. The ball 7 is made an integral part of the shorter member 6, being attached by the stand off 21 to allow the shorter member 6 to pivot around the end of the leg 2. A socket 8 is formed in the end of the leg 2, such that the shorter member 6 can be opened and closed. The longer member 9 is hinged to the end of the other leg 2 by means of a ball 10 and socket 11 joint, with the ball 10 made an integral part of the longer member 9, being attached by the stand off 22. The socket 11 is formed in the end of the leg 2, such that the longer member 9 can be opened and closed. The shorter member 6 is attached to the longer member 9 by a hinge 12, which is shaped to allow the longer member 9 to close over the shorter member 6. The hinge 12 is placed along the longer member 9, such that when the longer member 9 is closed over and becomes positioned adjacent to the shorter member 6, the legs 2 are pivoted around the spline 3 to the closed position shown in FIG. 2, with the material-engaging end portions 23 forced together to hold loose-leaf sheet materials.

The end of the shorter member 6 is terminated in a catch 14. The end of the longer member 9 is terminated in a latch 13, which is placed so that when the longer member 9 is closed over the shorter member 6, the latch 13 engages the catch 14 to hold the members 6 and 9 closed.

The latch 13 is formed with a first manipulation pad 24 to facilitate the opening and closing of the latch 13. A second manipulation pad 44, as shown in FIG. 1, may be formed as part of a leg 2 to provide a fingerhold to steady the binding unit 1, while closing or opening the latch 13. The second manipulation pad 44 may be placed on the leg 2, and constructed to be of a height such that, when the binding unit 1 holding a stack of material is set flat, the edges of the manipulation pad 24 and second manipulation pad 44 allow the binding unit 1 to lie in the same plane as the stack of material.

As the longer member 9 is opened, the ends of the legs 2, attached to members 6 and 9, are drawn closer together. This movement forces the legs 2 to pivot around the spline 3, so that the free edges 20 are opened to release any retained materials, and allow another stack of material to be placed between the legs 2, to be clamplingly retained when the members 6 and 9 are closed.

Figure 3:
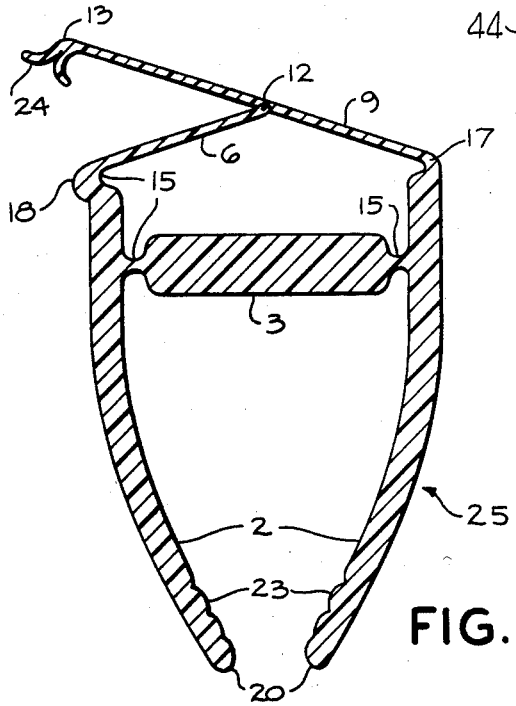
FIG. 3 is a sectional view of another embodiment of the present invention in the open position thereof.

FIG. 3 illustrates an embodiment, generally designated 25, which is generally similar to the binding unit 1. Each leg 2 is joined to one end of the spline 3 by a flexible web 15, serving as a hinge. The shorter member 6 is joined to one leg 2 by a flexible web 16. The longer member 9 is joined to the other leg 2 by a flexible web 17. A catch 18 is formed as an integral part of the leg 2 which is attached to the shorter member 6. The latch 13 engages the catch 18 when the longer member 9 is closed over the shorter member 6.

Figure 4:
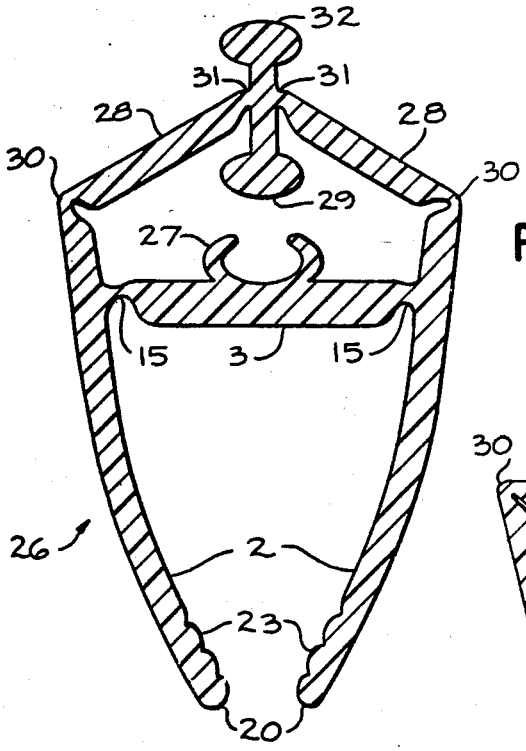
FIG. 4 is a sectional view of another embodiment of the present invention in the open position thereof.
Figure 5:
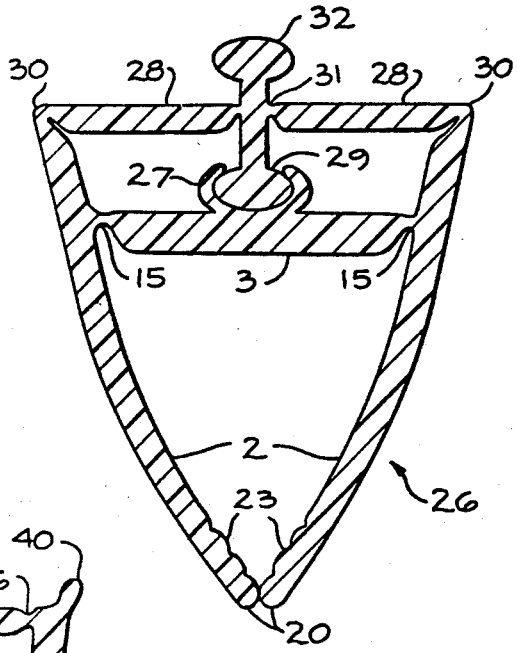
FIG. 5 is a sectional view of the embodiment of FIG. 1 showing it in the closed position thereof.

FIGS. 4 and 5 illustrate another embodiment, generally designated 26, which is generally similar to the binding unit 1. The legs 2 pivot around the spline 3. In FIG. 4, the legs 2 converge toward each other from the remote end to the free edges 20. In. FIG. 4*a* as shown in binding unit 80, the legs 2 converge toward each other from the spline 3 to the free edges 20. In FIG. 4*b*, as shown in binding unit 82, the legs 2 are generally parallel from the remote end to the spline 3, thence converge toward each other to the free edges 20. Each leg 2 is attached to a forcing member 28 by a flexible web 30. The other end of each forcing member 28 is attached to a wedge 29 by a flexible web 31. A keeper 27 is formed as an intergral part of the spline 3, and positioned to receive the wedge 29. When the wedge 29 is inserted into the keeper 27, the forcing members 28 spread the remote ends of the legs 2, causing the legs 2 to pivot around the spline 3 so that the free edges 20 close and the material engaging end portions 23 can clampingly engage a stack of loose-leaf materials. The top of the wedge 29 extends to form a fourth manipulation pad 32 so that the wedge 29 can be easily removed from the keeper 27 to open the free edges 20 of the legs 2.

Figure 6:
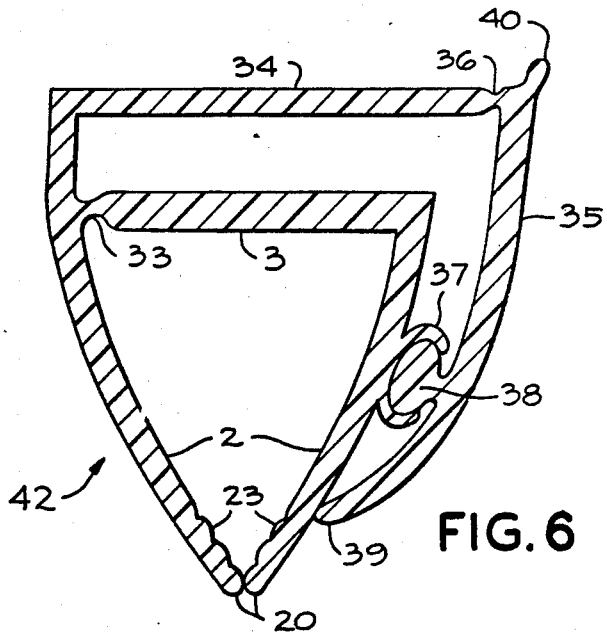
FIG. 6 is a sectional view of another embodiment of the present invention.
Figure 7:
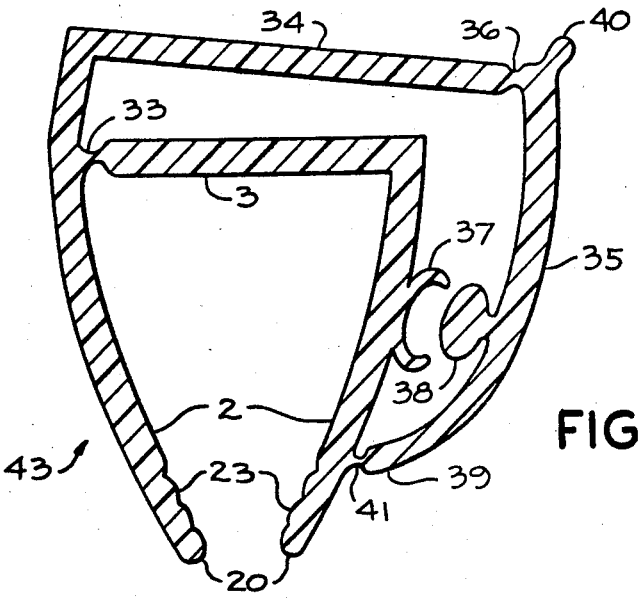
FIG. 7 is a sectional view of another embodiment of the present invention.

FIGS. 6 and 7 show still other embodiments, generally designated 42 and 43, of the binding unit 1.

FIG. 6 shows one leg 2 joined to the spline 3 by a flexible web 33, so that the leg 2 can pivot around the spline 3. The other leg 2 is non-pivotally attached to the spline 3. A keeper 37 is made an integral part of the non-pivotal leg 2.

A first clamping member 34 is rigidly attached to the remote end of the pivotal leg 2. The first clamping member 34 is attached to a second clamping member 35 by a flexible web 36. A wedge 38 is formed as an integral part of the second clamping member 35, and positioned so that, as the wedge 39 is inserted into the keeper 37, one end 39 of keeper 37, one end 39 of the second clamping member 35 will act as a fulcrum, the shape of the second clamping member 35 being curved as shown in FIG. 6 so that the second clamping member 35 will pivot around the fulcrum and import a force through the first clamping member 34 to pivotal leg 2, thereby providing pivotal movement of the pivotal leg 2 around the spline 3 to the closed position, causing the material engging end portions 23 to be clampingly secured on the edge of a stack of loose-leaf materials.

A third manipulation pad 40 is formed as an integral part of the second clamping member 35 to facilitate the removal of the wedge 38 from the keeper 37. This removal opens the free edges 20 of the embodiment 42 to release any secured material and allow another stack of material to be placed between the legs 2 to be held by the embodiment 42, after the wedge 38 is engaged in the keeper 37.

FIG. 7 illustrates a modification of the embodiment 42 shown in FIG. 6. The operation of the modified embodiment 43 is similar to that of the embodiment 42, except that the second clamping member 35 is joined to the non-pivotal leg 2 by a flexble web 41 to facilitate the alignment of the wedge 38 with the keeper 37, while closing the modified embodiment 43.

Certain of the embodiments are shown to have the free edges 20 apart when the opening and closing means is open. This state is not necessary, and for certain uses such as binding a small number of loose-leaf sheets, it may be preferred to have the free edges touching when the opening and closing means is open so that additional clamping force can be generated by the closing of the opening and closing means to more securely hold a thin stack of material.

Figure 8:
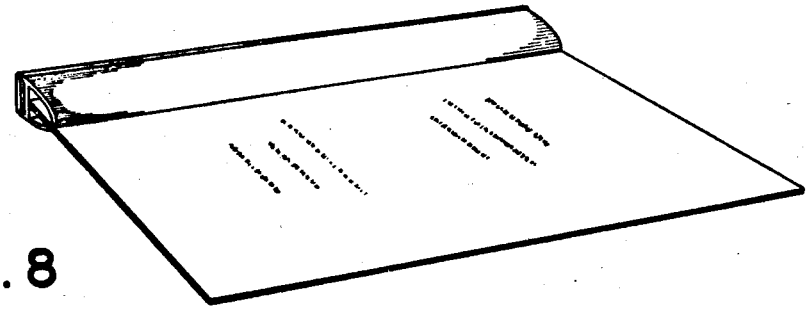
FIG. 8 is a perspective view of illustrating a binding unit utilized to bind one edge of a stack of loose-leaf sheets.

Referring now to FIG. 8, there is shown in perspective a stack of loose-leaf sheets temporarily bound together at one edge by means of the binding unit. The strip depicted is not intended to represent any specific embodiment, but rather depicts a manner in which strips of the binding unit are utilized.

Figure 9:
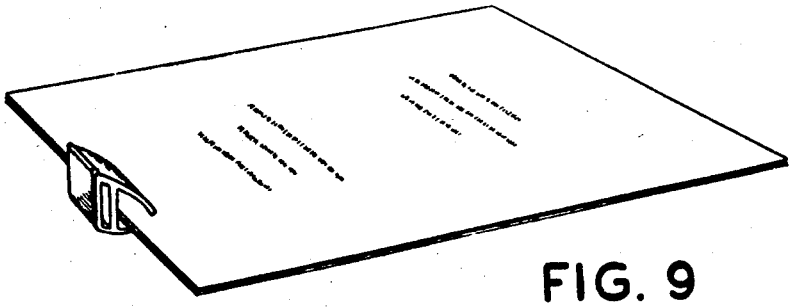
FIG. 9 is a perspective view showing a short section of a binding unit utilized to hold a stack of loose-leaf sheets.

Referring now to FIG. 9, there is shown, in perspective, a stack of loose-leaf sheets temporarily held together along a portion of an edge by means of a length of the binding unit. The length depicted is not intended to represent any specific embodiment or size, but rather depicts a manner in which less than full edge lengths of the binding unit are utilized to temporarily bind loose-leaf materials.

As described in my above identified U.S. patent application which is a continuation-in-part of Ser. No. 362,021 and bears the Ser. No. 454,320, filed Dec. 29, 1982, FIGS. 10*a*, 10*b*, 10*c*, and 10*d*, show still another embodiment, generally designated 70, of the binding unit 1. This embodiment is similar to that shown in FIGS. 6 and 7, except that it can be shifted to have different clamping positions and thus different clamping forces.

Figure 10A:
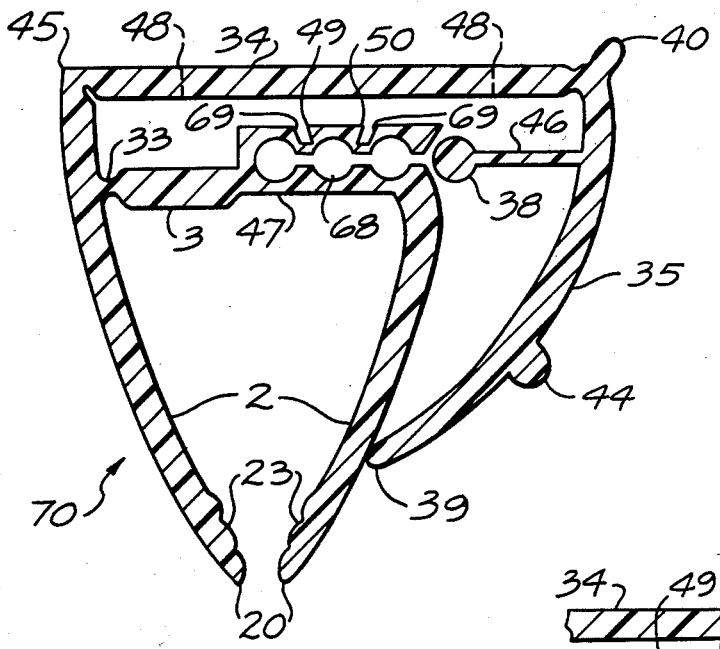
FIG. 10*a* is a sectional view of another embodiment of the invention, showing a latch for the clamping members in the open position.

FIG. 10*a* shows one leg 2 joined to the spline 3 by a flexible web 33, so that the leg 2 can pivot around the spline 3. The other leg 2 is non-pivotally attached to the spline 3. It will be appreciated that certain modifications to the structure illustrated in FIG. 10*a* may be made. For example, the function of the flexible web 33 may also be accomplished by a ball and socket joint, pin hinge, or the like.

The first walls 68, inside the keper 47 provide a a plurality of holes to hold a wedge 38 in three positions. Keeper 47 is made an integral part of the spline 3. The thickness of the material which is used to form the keeper 47 is selected to provide a rigid support between the legs 2, and yet allow the insertion of the wedge 38. The removal of material to form the third walls 69 which partially define grooves in the top of the keeper 47 adds even more flexibility to the keeper 47 to ease the insertion and removal of wedge 38. The edges at the opening to first walls 68 of the keeper can be shaped to facilitate the movement of the wedge 38 into and out of any one of the three positions in the keeper 47.

A first clamping member 34, having second walls 48 defining a plurality of holes, is rigidly attached to a second clamping member 35. The other end of the first clamping member 34 is attached to the remote end of the pivotal leg 2 by a flexible web 45. A wedge 38 is formed as an integral part of the second clamping member 35, being attached by the stand off 46 and positioned so that as the wedge 38 is inserted into the keeper 47, an end 39 of the second clamping member 35 will act as a fulcrum. The second clamping member 35 will then pivot around the fulcrum and apply a force through the first clamping member 34 to the pivotal leg 2. The end 39 of the second clamping member 35 could be attached to the non-pivotal leg 2 by means such as a flexible web 41 shown in FIG. 7.

The closing edge 49, formed by third walls 69 in the keeper 47, accessible through the holes in the first clamping member 34, provides a place to grip the binding unit 70 as the wedge 38 is inserted into the keeper 47. The holes formed by second walls 48 in the first clamping member 34 which provide access to the closing edge 49 are positioned so as not to interfere with the movement of the first clamping member 34 as the wedge 38 is inserted into, or removed from, keeper 47.

Figure 10B:
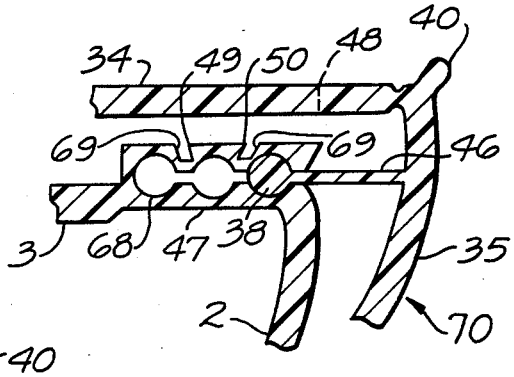
FIG. 10*b* is a sectional view of the latch shown in FIG. 10*a*, showing the latch in the first closed position.
Figure 10C:
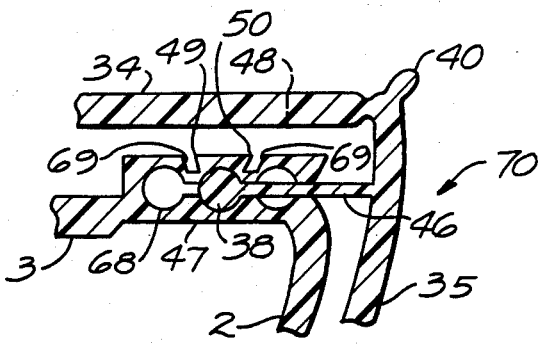
FIG. 10*c* is a sectional view of the latch shown in FIG. 10*a*, showing the latch in the second closed position.
Figure 10D:
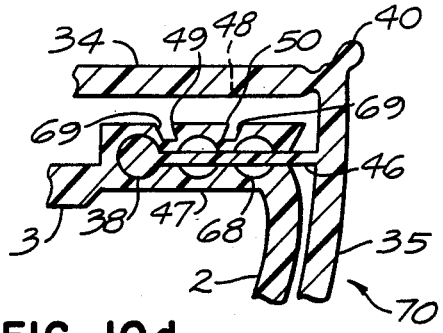
FIG. 10*d* is a sectional view of the latch shown in FIG. 10*a*, showing the latch in the third closed position.

The shape of the second clamping member 35 is selected so that when the wedge 38 is inserted into the first position of keeper 47, as shown in FIG. 10*b*, the material engaging end portions 23 can be clampingly secured the wedge 38 into the second position of the keeper 47, as shown in FIG. 10*c*, the binding unit applies increased force to clampingly secure the edge of a stack of loose-leaf material. By again moving the wedge 38 into the third position of the keeper 47, as shown in FIG. 10*d*, the force that clampingly secures the edge of a stack of loose-leaf material is further increased.

A third manipulation pad 40, formed as an integral part of the second clamping member 35, and the opening edge 50, formed by the third walls 69 in the keeper 47, are provided to facilitate the removal of the wedge 38 from the keeper 47. This removal opens the free edges 20 of the embodiment 70 to release any secured material and allow another stack of material to be placed between the legs 2, to be held upon the subsequent engagement of wedge 38 into keeper 47.

A second manipulation pad 44, as shown in FIG. 10*a*, may be formed as part of the second clamping member 35, to provide a fingerhold while inserting the wedge 38 into the keeper 47. The second manipulation pad 44 may be placed on the second clamping member 35 and constructed to be of a height such that when the binding unit 70 holding a stack of material is set flat, the edges of the manipulation pad 40 and second manipulation pad 44 allow the binding unit 70 to lie in the same plane as the stack of material.

Figure 11:
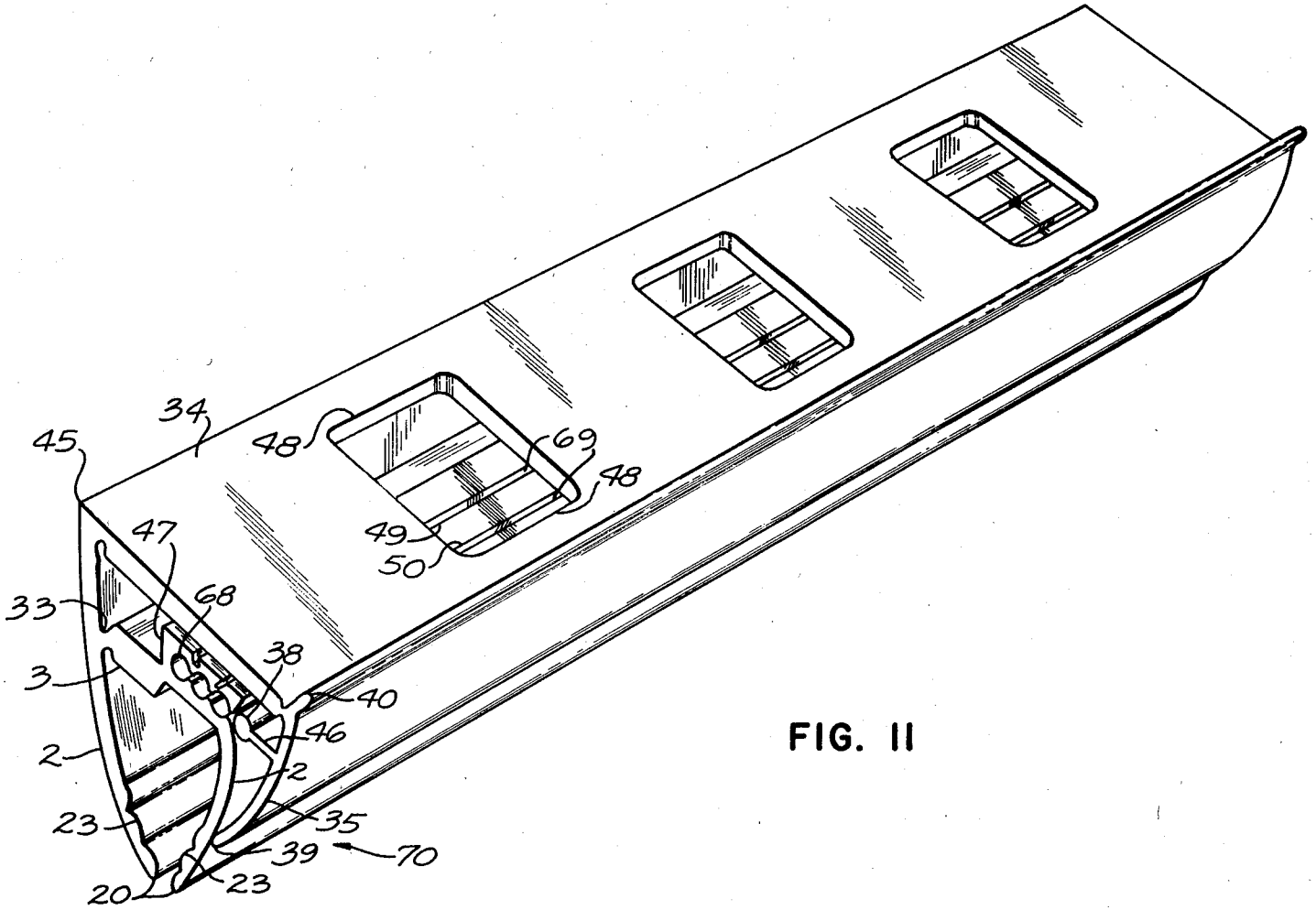
FIG. 11 is a perspective view of a strip of the binding unit sectional shown in FIG. 10*a;*

FIG. 11 shows third walls 69 forming grooves with edges 49 and 50 along the keeper 47.

FIG. 11 shows that the second walls 48 form holes placed periodically along a length of binding unit 70 to allow access to closing edge 49 and opening edge 50.

The user can engage closing edge 49 through the holes to provide a handle on the binding unit 70 while applying pressure to the second clamping member 35 to force the wedge 38 into the keeper 47. In a similar manner, the user can engage opening edge 50 to provide a handle on the binding unit 70 while applying pressure to the third manipulation pad 40 to force the wedge 38 out of the keeper 47.

Figure 12:
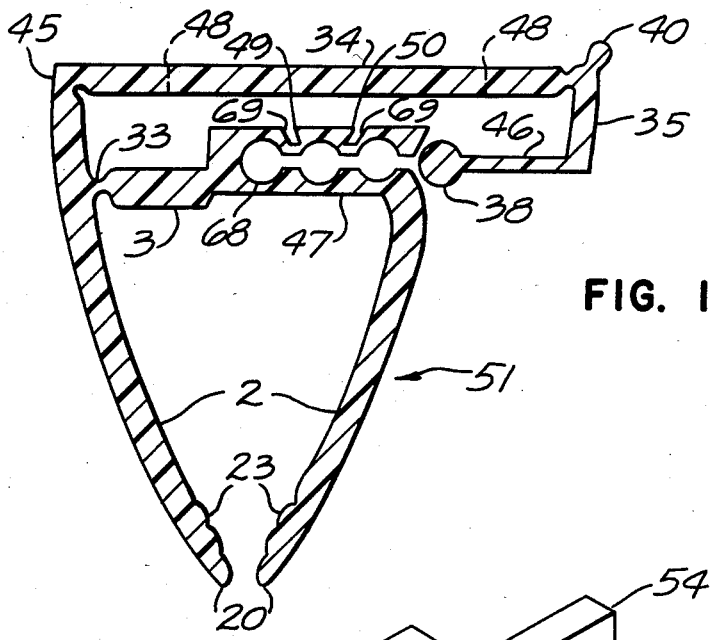
FIG. 12 is a sectional view of another embodiment of the invention in the open position thereof.

FIG. 12 illustrates a modification of the embodiment 70 shown in FIG. 10*a*. The operation of the modified embodiment 51 is similar to that of the embodiment 70, except that the second clamping member 35 is used only to join the first clamping member 34 to the stand off 46, and does not extend beyond the stand off 46. When the wedge 38 is inserted into the keeper 47, a force is applied through the first clamping member 34 to the pivotal leg 2, closing the material engaging end portions 23 on the edge of a stack of loose-leaf material.

Figure 13:
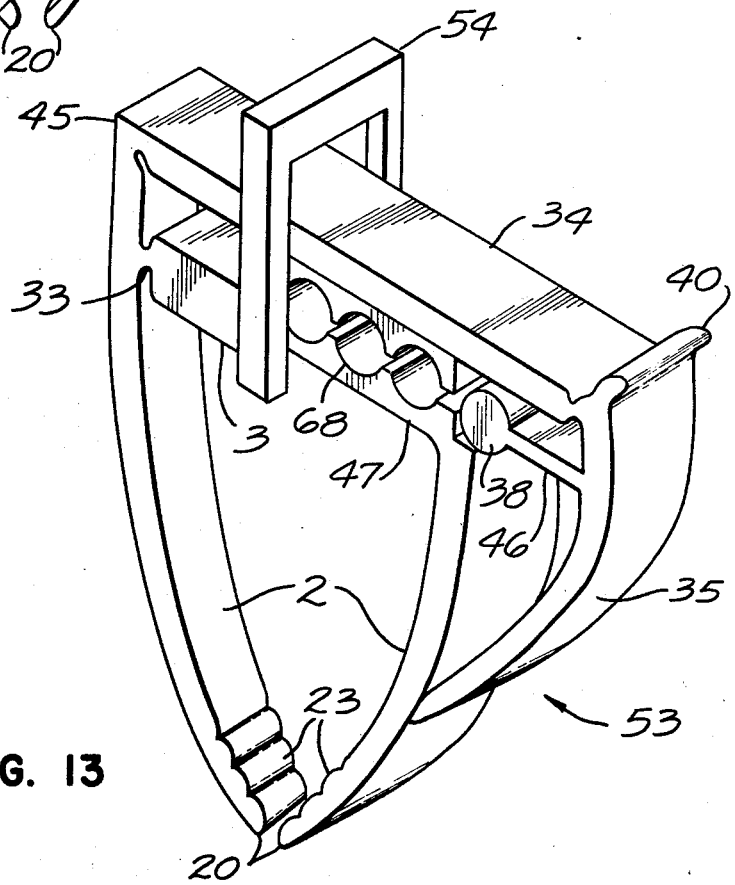
FIG. 13 is a perspective view of another embodiment of the invention, showing a handle on the spline.

FIG. 13 shows still another embodiment, generally designated 53, of the binding unit 1. The operation of this embodiment is similar to that of the embodiment 70, except that the first clamping member 34 does not allow access to the keeper 47. A handle 54 is made an integral part of the spline 3 and keeper 47, and is positioned to allow the first clamping member 34 to move freely between the sides of the handle 54. The handle 54 provides a place to hold onto the binding unit 53 as the wedge 38 is inserted into, or removed from, the keeper 47.

Figure 14:
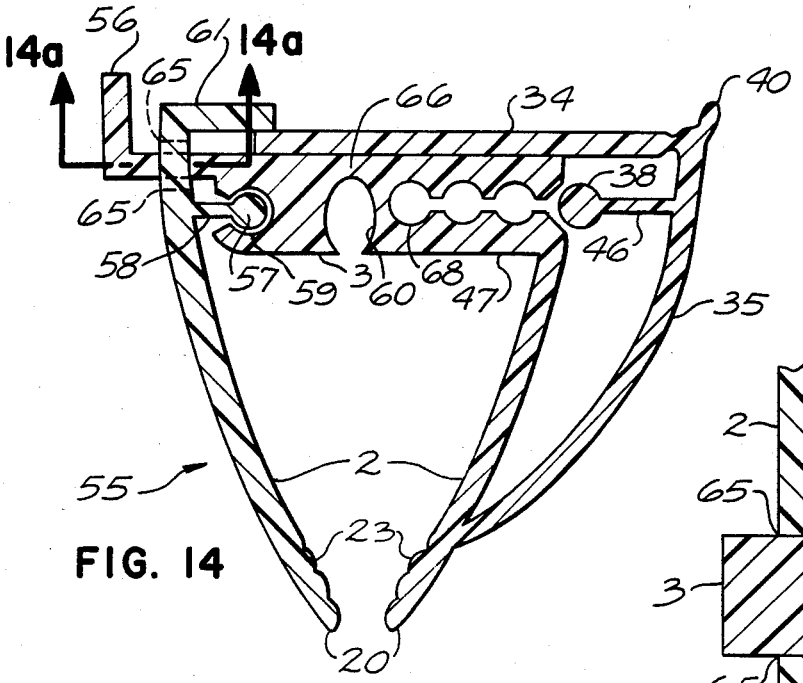
FIG. 14 is a sectional view of another embodiment of the invention, showing a handle formed by an extension of the spline.

FIG. 14 shows still another embodiment, generally designated 55, of the binding unit 1. The operation of this embodiment is similar to that of embodiment 53. The second handle 56 of this embodiment is rigidly attached to the end of an extension of the spline 3 at a point outside of the pivotal leg 2.

Figure 14A:
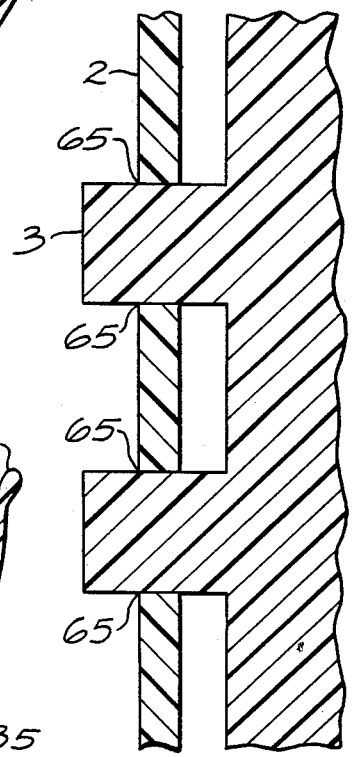
FIG. 14*a* is a sectional view of FIG. 14, showing how the handle extends through the leg.

FIG. 14*a* shows how fourth walls 65 define openings in the leg 2, through which the extensions of the spline 3 pass. The fourth walls 65 are placed so as not to limit the freedom of movement of either the spline 3 or the pivotal leg 2.

FIG. 14 shows the pivotal leg 2 attached to the spline 3 by means of a ball 57 and socket 59 joint. The ball 57 is made an integral part of the leg 2, being attached to the leg 2 by the stand off 58. The spline 3 has a socket 59 formed to accept the ball 57 and allow movement of the ball 57 and stand off 58 such that the pivotal leg 2 will open and close to its operational limits without restriction from the spline 3. A lip 61 is rigidly attached to the remote end of the pivotal leg 2. The first clamping member 34 is rigidly attached to the second clamping member 35, but is not attached to the pivotal leg 2. Instead, the lip 61 is located so as to hold the first clamping member 34 above the keeper 47 and spline 3.

The second clamping member 35 is rigidly attached to the non-pivotal leg 2 at a point such that the wedge 38 is aligned with the keeper 47.

A fifth wall 60 defines a rounded groove in the spline 3 to form a flexible web 66 in the spline 3, such that the free ends 20 of the legs 2 can be opened wider than allowed by just the pivotal movement of leg 2. After the pivotal leg 2 has reached its normal open operational limit, the spline 3 will bend at the flexible web 66 to allow the legs 2 to be further opened to accept a stack of loose-leaf material. The spline can then return to a non-flexed configuration as the legs 2 close around the stack of loose-leaf material. Thus, this embodiment can accept a of stacked sheets without damaging the sheets as they are inserted or removed. The second handle 56 will allow the user to hold the binding unit 55 while force is applied to the outside of the second clamping member 35 to insert the wedge 38 into the desired position of the keeper 47 to clampingly retain the loose-leaf material with the selected force in a latched state.

The second handle 56 can also be used to hold the binding unit 55 while force is applied to the third manipulation pad 40 to remove the wedge 38 from the keeper 47 to release the loose-leaf material or lessen the force which clampingly retains the stack of loose-leaf material.

As the wedge 38 is inserted into the keeper 47, the first clamping member 34 slides under the lip 61 to apply a force on the remote end of the pivotal leg 2, causing the pivotal leg 2 to pivot around the spline 3 to close the material engaging end portions 23 to clampingly hold loose-leaf sheet materials.

Figure 15:
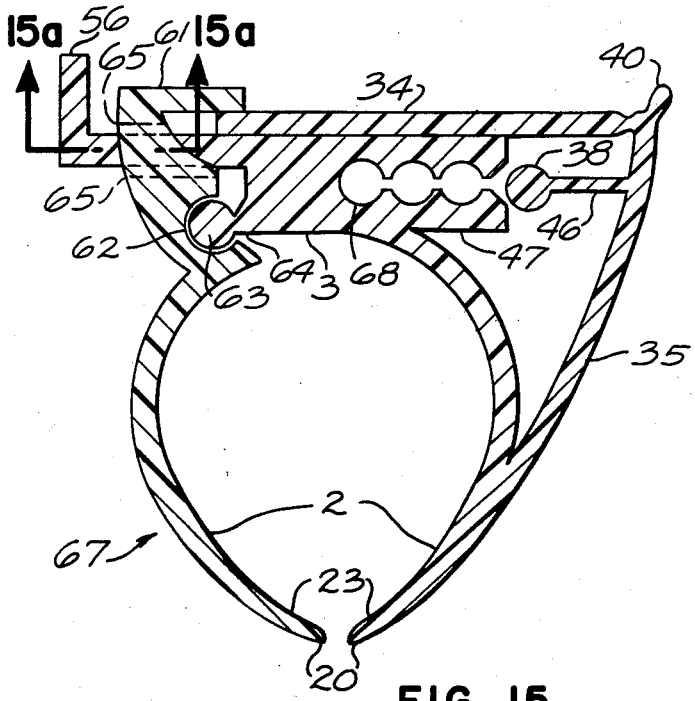
FIG. 15 is a sectional view of another embodiment of the invention, showing a handle on an extension of the spline and shaped legs.

FIG. 15 shows yet another embodiment, generally designated 67, of the binding unit 1. The operation of this embodiment is similar to that of embodiment 55.

Figure 15A:
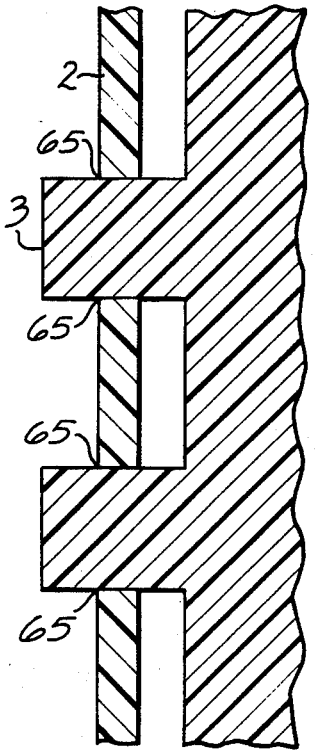
FIG. 15*a* is a sectional view of FIG. 15, showing how the handle extends through the shaped leg.

FIG. 15*a* shows how the fourth walls 65 define holes in the remote end of the pivotal leg 2 through which pass the extensions of the spline 3 which are rigidly attached to the second handle 56.

FIG. 15 shows that the pivotal leg 2 is attached to the spline 3 by means of a ball 63 and socket 62 joint. The ball 63 is made an integral part of the spline 3, being attached to the spline 3 by the stand off 64. The pivotal leg 2 has a socket 62 formed to accept the ball 63 and allow movement of the pivotal leg 2 to its operational limits without restriction from the spline 3.

A lip 61 to hold the first clamping member 34 on top of the keeper 47 and spline 3 is also provided.

The legs 2 of binding unit 67 are depicted in one of several possible configurations for a binding unit. This configuration has each leg formed to curve outwardly from the point where they are attached to the spline to a point where the legs become parallel, and then curve inwardly as the legs terminate with the material engaging end portions 23. The legs could be formed to be straight from the remote end to the free end 20, so that the outer surface of the legs 2 become closer together when the binding unit is in the closed position. The legs could also be formed to converge inwardly from the spline 3 to the free end 20 while that portion of the pivotal leg 2 from the spline 3 to the remote end is generally perpendicular to the spline 3. The legs could likewise be formed to taper inwardly from the spline 3 to the remote end and inwardly from the spline 3 to the free end 20.

Figure 16:
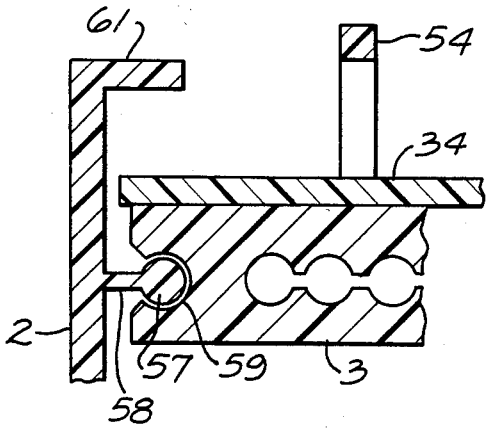
FIG. 16 is a sectional view of another embodiment of the invention, showing a handle on the spline and an extended leg.

FIG. 16 shows a modification of embodiments 55 and 67 shown in FIGS. 14 and 15, respectively. This modification substitutes the handle 54 used in embodiment 53, depicted in FIG. 13 for the second handle 56. This modification also shows an elongation of the remote end of the pivotal leg 2 between the lip 61 and the point where the pivotal leg 2 is attached to the spline. This elongation will allow the first clamping member 34 to engage the pivotal leg 2 at any point between the spline 3 and the lip 61, depending upon the thickness of the stack of loose-leaf material and the selected position of the wedge 38 in the keeper 47.

The flexible webs which function as a hinge in FIGS. 3, 4, 5, 6, 7, 10*a*, 11, 12, and 13, can be formed of the same material as the binding unit, but of a reduced thickness, to allow the material to bend easily at that point. The edges adjacent the flexible webs must be formed in a manner which does not restrict the freedom of movement of the members attached to the flexible webs.

The above flexible webs could be constructed of fabric, the ends of which are embedded in the members to be joined by the flexible webs.

Figure 17:
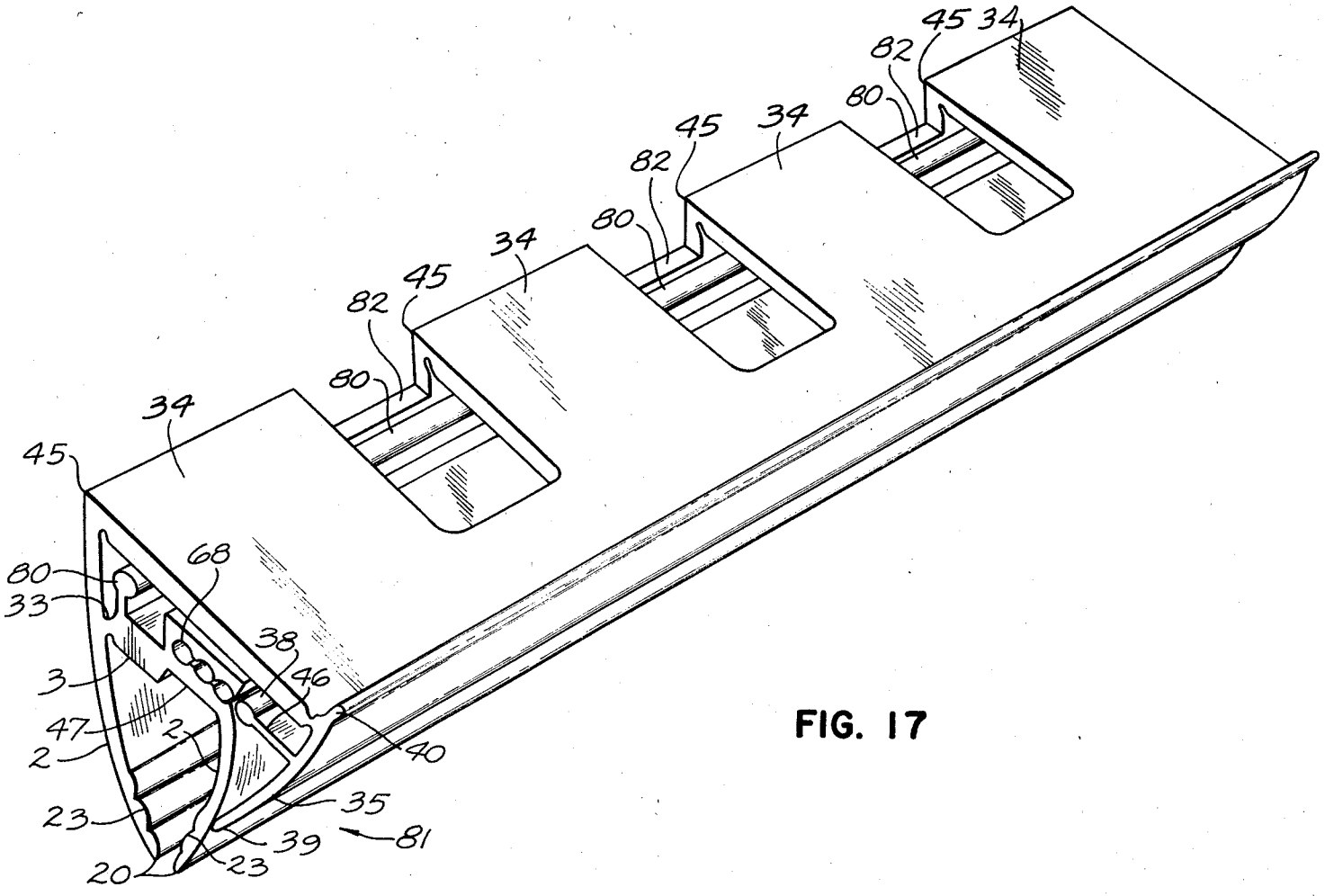
FIG. 17 is a perspective view of another embodiment of the invention, showing a third manipulation pad mounted on the spline.

FIG. 17 depicts yet another embodiment, generally designated 81, of the binding unit 1. The operation of this embodiment is similar to that of embodiment 70.

FIG. 17 shows how the sixth walls 82 define a plurality of holes placed periodically in the remote end of the pivotal leg 2 and continuing in the first clamping member 34. These holes allow access to the fifth manipulation pad 80 located at the edge of the spline 3 nearest the remote end of the pivotal leg 2. The size and position of the holes are selected so as not to interfere with the movement of the first clamping member 34 and such that the user can then engage the fifth manipulation pad 80 while forcing the wedge 38 into or out of the keeper 47.

The fifth manipulation pad 80 can be placed along the entire length of the spline 3 as shown in FIG. 17 or only placed at the holes created by the sixth walls 82. As the fifth manipulation pad 80 provides a handle, the closing edge 49 and opening edge 50 formed by third walls 69 in binding unit 70 are not necessary for handle purposes in binding unit 81. Otherwise the operation of binding unit 81 is similar to binding unit 70.

Figure 18:
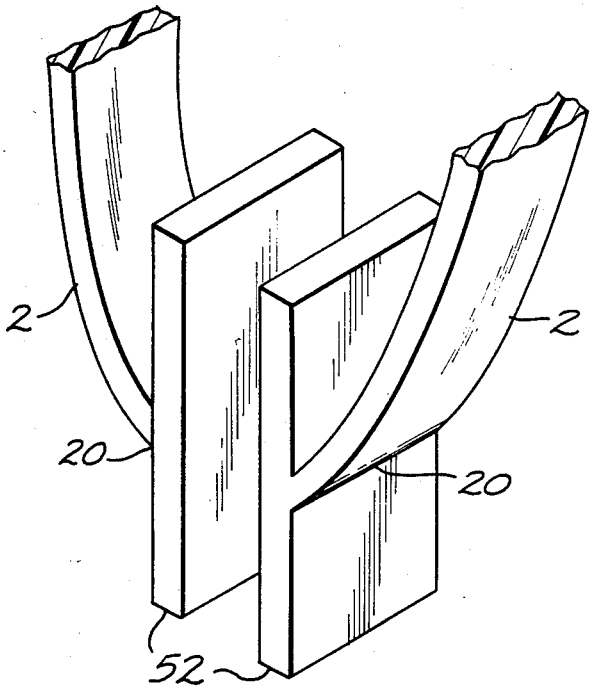
FIG. 18 is a perspective view of another embodiment of the invention, showing material engaging plates.

FIG. 18 depicts a modification of the embodiments shown in FIGS. 1 through 7 and FIGS. 10*a* through 17. This modification incorporates enlarged material engaging plates 52 at the free edges 20 of the legs 2 to clampingly secure the stack of loose-leaf material after it has been inserted between the legs 2. The opposing planar surfaces of the plates 52 provide a larger area to clampingly receive the stack than the area supplied by the opposing ridge configuration. The planar surface of the plates 52 promotes the object of this invention to provide a binding unit which does not damage the stack, particularly with the increased clamping force provided by embodiments 51, 53, 55, 67, 33, or 70.

Figure 19:
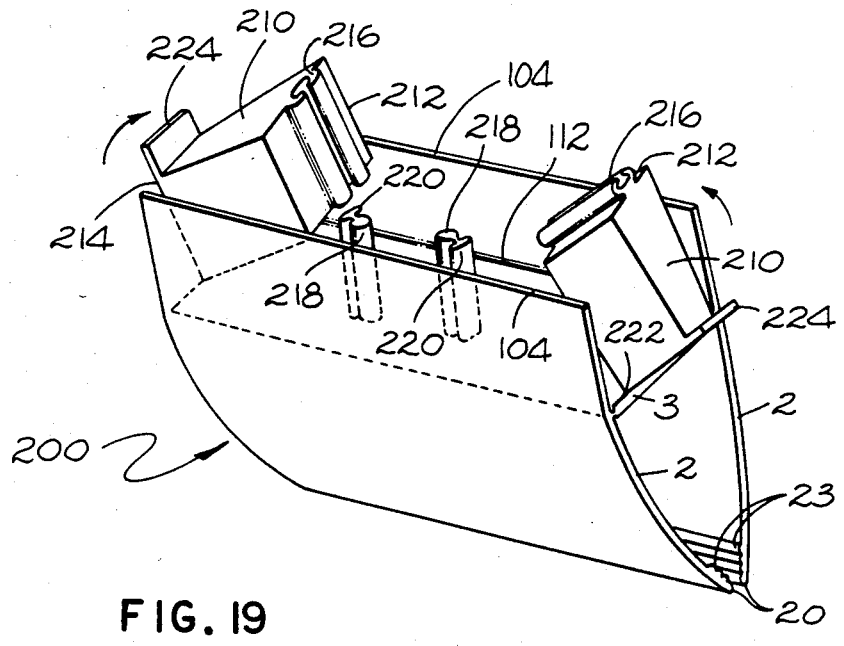
FIG. 19 is a perspective view of another embodiment of the invention, in the open position thereof.

Now referring to the embodiment of binding unit 200 shown in FIG. 19, the two legs 2 are joined by a spline 3 near the remote ends 104 of the two legs 2 by spline hinge means comprising a flexible web 112. The free edges 20 of the legs 2 have cooperating, material-engaging end portions 23 facing each other so that when the stack of loose-leaf material is inserted between the legs 2 and the remote ends 104 moved apart, the legs 2 will pivotally move around the spline 3 to have the material-engaging end portions clampingly hold the stack of loose-leaf material in the binding unit 200. The pivotal movement of the legs 2 around the spline 3 is controlled by the positioning of the moving means. The moving means is made up of a first wedge 210 having a first end 212 and a second end 214. The first wedge 210 tapers from a first preselected width at the first end 212 to a second preselected width smaller than the first preselected width at the second end 214. The first wedge 210 is attached alone one edge of either the first end 212 or the second end 214 by first wedge hinge means 222 to the side of the spline 3 remote from the free edges 20. A smoother closing of the binding unit 200 is achieved if the smaller second end 214 of the first wedge 210 is attached to the spline 3. The rotation of the first wedge 210 to be positioned adjacent the side of the spline 3 remote from the free edges will impart a gradual force against the remote ends 104 for at least the first forty five degrees of rotation of the first wedge 210. Whereas, if the larger first end 212 is attached to the spline 3, the remote ends 104 will be fully spread apart upon only a few degrees of rotation of the first wedge 210.

Figure 24:
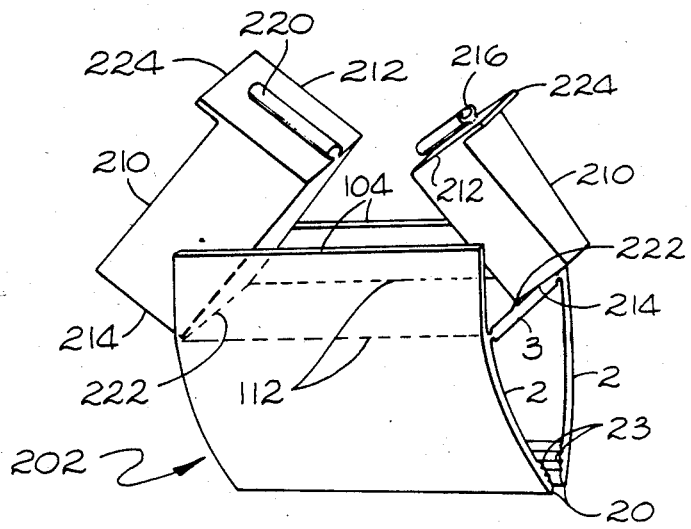
FIG. 24 is a perspective view of another embodiment of the present invention in the open position thereof.

FIG. 19 depicts a second end 214 of the first wedge 210 attached by wedge hinge means 222 to the spline 3. Attaching this end has the advantage that as the first wedge 210 is rotated to a position adjacent the spline 3 as shown in FIG. 24, the tapered sides 228 of the first wedge 210 joining the shorter preselected length of the second end 214 to the wider preselected length of the first end 220 will come in contact with the remote ends 104 and push the remote ends 104 apart. When the remote ends 104 are pushed apart, the free edges 20 with the material-engaging end portions 23 are moved to the closed position thereof. The preselected length of the end 212 is selected so that when the first wedge 210 is positioned adjacent the spline 3, the width of the first end 212 will cause the remote ends 104 to be moved apart a sufficient distance to pivot the legs 2 around the spline 3 and cause the free edges 20 to be moved to the closed position thereof.

In order to insure that the first wedge remains positioned adjacent to the spline 3, a latch means is added to the binding unit 200. FIG. 19 shows the latch means to be made up of a keeper 216 mounted on the end of the first wedge 210 remote from the first wedge hinge means 222. A standoff 218 is mounted on the side of the spline 3 remote from the free edges 20 in a position set apart from the keeper 216 when the first wedge 210 is positioned adjacent to the spline 3. A second wedge 220 is mounted on the stand-off 218 and positioned to be retained in the keeper 216 when the first wedge 210 is positioned adjacent to the spline 3.

A manipulation pad 224 is mounted on one end of the first wedge 210 and extended to allow the manipulation pad to be engaged by the user's fingers to aid the user in rotating the first wedge 210 from the position adjacent the spline 3 to a position spaced apart from the spline 3.

Figure 20:
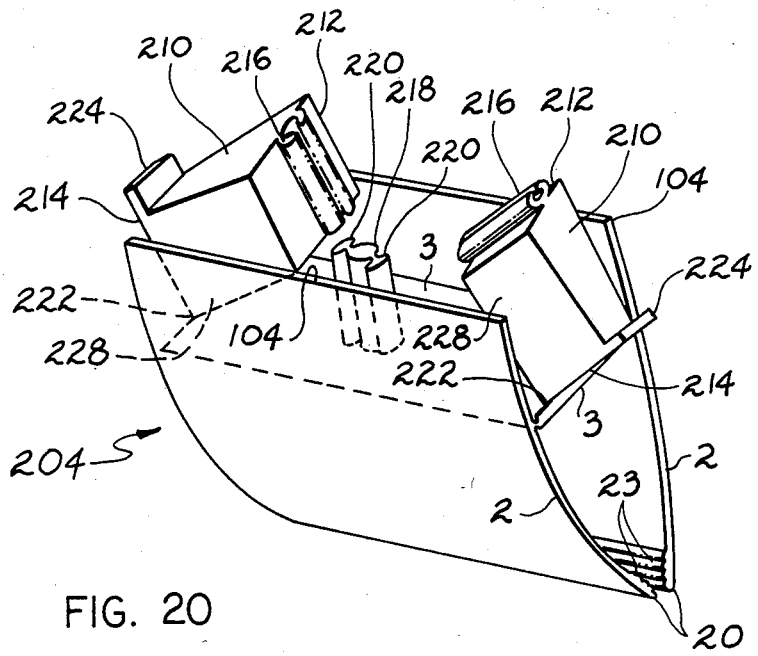
FIG. 20 is a perspective view of another embodiment of the present invention in the open position thereof.

Now referring to the embodiment of binding unit 204 shown in FIG. 20, the two legs 2 are rigidly joined to a spline 3 near the remote ends 104 of the two legs 2. The embodiment has two wedges of similar makeup as that described in the embodiment of the binding unit 200 as shown in FIG. 19. Each wedge is attached to the spline 3 by first wedge hinge means 222. A single standoff 218 is mounted on the side of the spline 3 remote from the free edges 20 in a position set apart from the keeper 216 when the first wedges 210 are positioned adjacent to the spline 3. Two second wedges 220 are mounted on either side of the standoff 218 and each positioned to be retained in one of the keepers 216 of one of the first wedges 210. The length of the tapered sides 228 selected to place the keeper 216 in a position to be retained by the second wedge 220.

Figure 21:
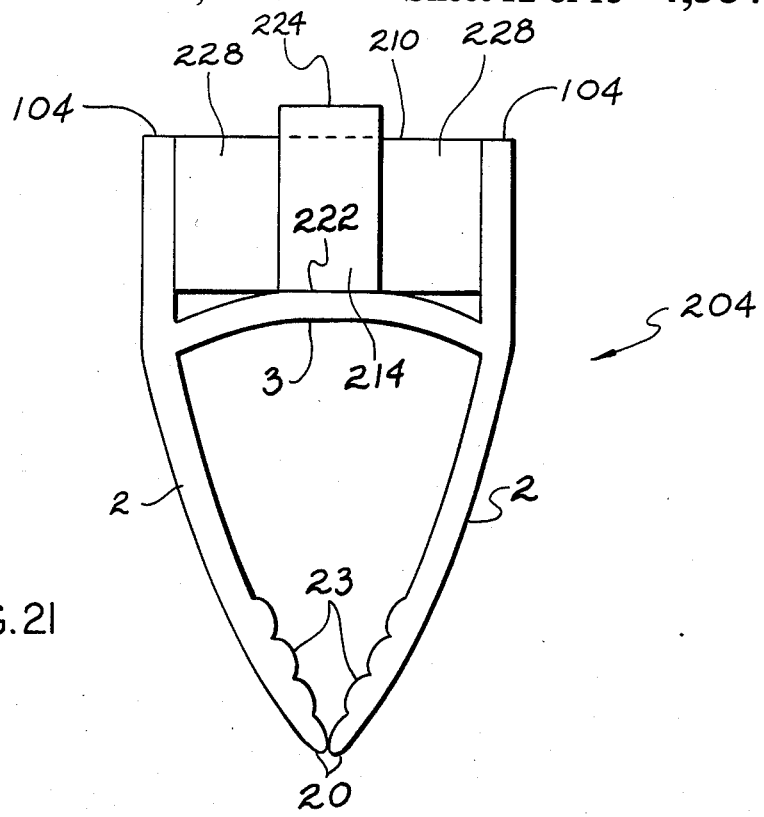
FIG. 21 is an end view of another embodiment of the present invention in the closed position thereof.

FIG. 21 shows the operation of binding unit 204 in the closed position thereof. Because the spline 3 is rigidly attached to the legs 2 with the free edges 20 in an open position thereof, when the first wedge 210 is moved to a position adjacent to spline 3 to force the remote ends 104 apart, the spline 3 will deform slightly to allow the free edges 20 of the legs to attain the closed position thereof. Thus, when the wedge 210 is rotated to a position apart from the spline 3, the spline 3 will resume it's original configuration respective the legs 2, and the legs 2 will be moved to an open position thereof.

Figure 22:
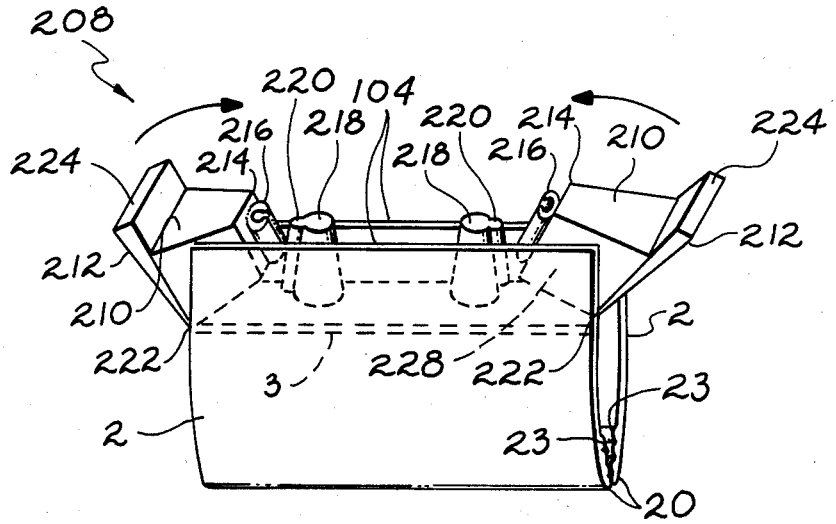
FIG. 22 is a perspective view of another embodiment of the present invention in the open position thereof.

FIG. 22 depicts another embodiment 208 of the present invention that is similar in operation to embodiment 200 depicted in FIG. 19. The primary difference is that the wedge 210 is attached to spline 3, remote from the free edges by the first edge 212, rather than the second end 214.

Figure 23:
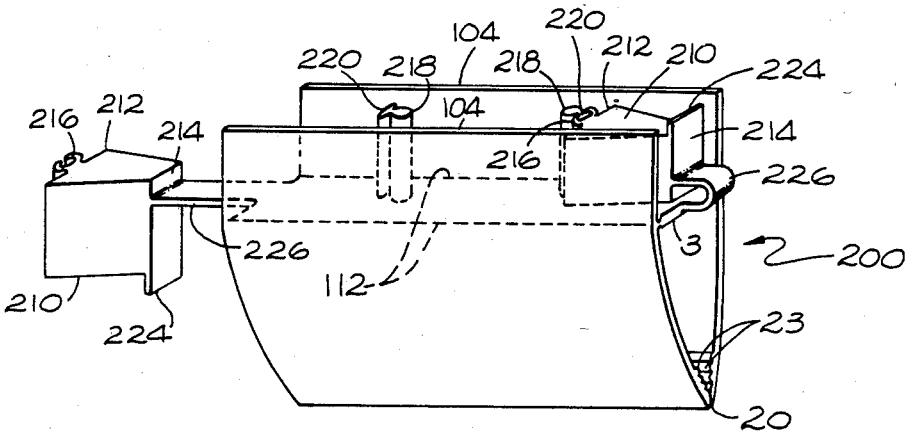
FIG. 23 is a perspective view of another embodiment of the present invention with one moving means in the open position thereof and another moving means in a closed position thereof.

FIG. 23 shows binding unit 201 as having a hinge means for the first wedge 210, consisting of a living hinge 226. The living hinge 226 is a loop of flexible material having one end of the loop attached to a spline 3 and the other end of the loop attached to the first wedge 210. The living hinge 226 can be formed as a straight band or a curved loop with memory. If used as a straight band, the living hinge 226 will hold the first wedge in a position extended from the spline 3 away from the remote ends 104. This configuration has the advantage of allowing the user to manipulate the remote ends 104 without interference by the first wedge 210. If the living hinge 226 is a curved loop with memory that holds the first wedge 210 in a position above and spaced apart from the side of the spline 3 remote from the free edges 20, the user may easily insert the first wedge 210 between the remote ends 104 to close and latch the binding unit 200 in the closed position thereof. The memory of either the straight band configuration or the curved loop configuration of the living hinge 226 should not be of such to impart a force upon the first wedge 210 to remove the first wedge 210 from the latch position thereof.

FIG. 24 shows yet another embodiment of a binding unit 202 similar to the binding unit shown in FIG. 23. The configuration of the first wedge 210 is elongated and a set of two first wedges 210 latched together to maintain the binding unit 202 in a closed position thereof.

The pair of first wedges 210 are mounted on the spline 3 by means of the first wedge hinge means 222 at edges of each first wedge 210 remote from each other. The adjacent edges of each first wedge 210 contain a latch means comprising a second wedge 220 mounted on one of the first wedges 210 with a keeper 216 mounted on the adjacent end of the other first wedge 210. The length of the tapered sides 228 is selected and the two first wedges 210 are mounted so that when both of the first wedges 210 are rotated to a position adjacent the spline 3 the second wedge 220 is removably engaged in the keeper 216.

For a binding unit 202 that runs the length of a stack of loose-leaf material, a plurality of pairs of first wedges 210 may be utilized to exert the closing force on the remote ends 104 at preselected points along the length of the binding unit 202.

A manipulation pad 224 is mounted on one end of each of the first wedges 210 and extended to allow the manipulation pad to be engaged by the user's fingers to aid the user in rotating each of the pair of first wedges 210 from the position adjacent to spline 3 to a position spaced apart from the spline 3.

FIG. 25 shows yet another embodiment of a binding unit 206 similar in function to the binding unit 202 as shown in FIG. 24. In FIG. 25 the legs 2 are shown to be rigidly attached to the spline 3 at a position near the remote ends 104 of the legs 2. FIG. 26 shows the wedge 210 in a position adjacent the spline 3 whereby the binding unit 206 is in a closed position thereof. As the wedge 210 is inserted between the remote ends 104, the remote ends 104 are forced apart. Because the legs 2 were rigidly attached to the spline 3 in an open position thereof, as the legs 2 are moved to the closed position thereof, the spline 3 will deform slightly. When the wedge 210 is rotated to a position away from the spline 3, the spline 3 will regain its original configuration and the legs 2 will assume an open position thereof.

Figure 27:
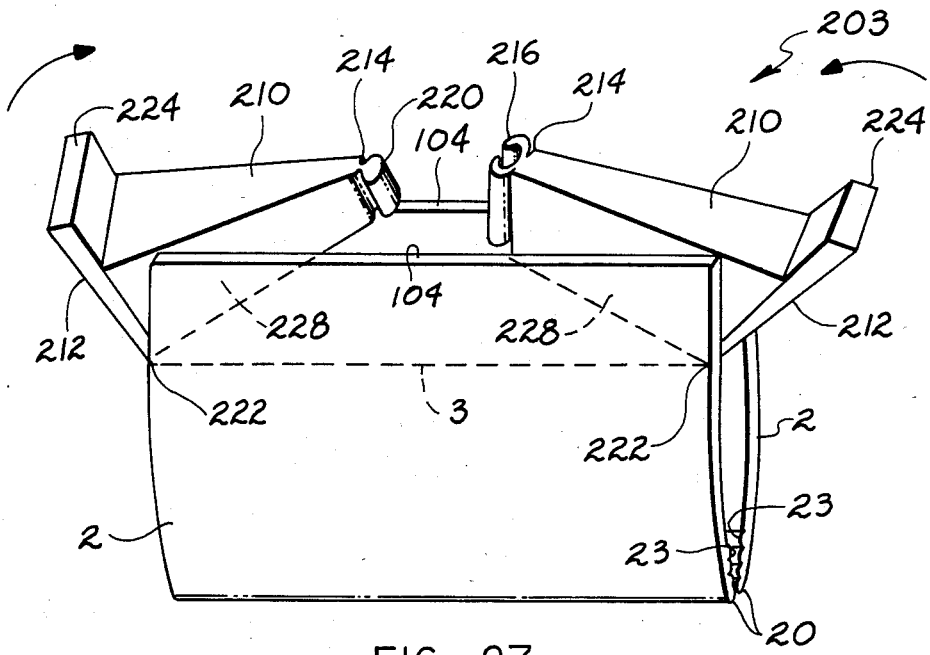
FIG. 27 is a perspective view of another embodiment of the present invention in the open position thereof.

FIG. 27 shows yet another embodiment of the binding unit 203 which is similar in operation to embodiment 202 depicted in FIG. 24. FIG. 27 shows the first end 212 as attached to the spline 3 on the side remote from the free ends 20 by first wedge hinge means 222.

Figure 28:
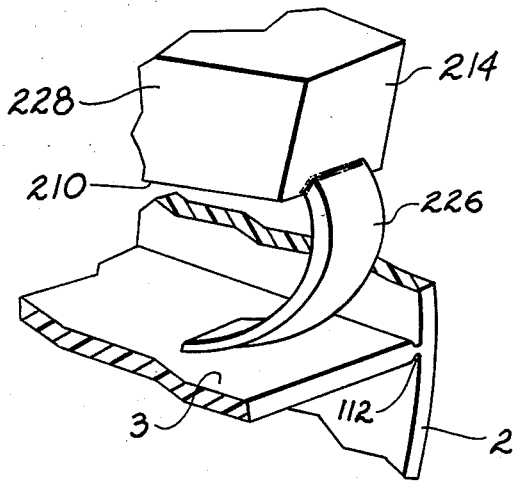
FIG. 28 is a partial perspective view of another embodiment of the present invention in the open position thereof.

The first wedge hinge means 222 as depicted in FIG. 27 is a flexible web that attaches one edge of one end of the first wedge 210 to the side of the spline 3 remote from the free edges 20. FIG. 28 shows a detailed view of the first wedge hinge means to be a living hinge 226 similar to that described for the binding unit 201 shown in FIG. 23. The living hinge 226 is made of a curved loop of flexible material having one end attached to the side of the spline 3 remote from the free edges 20 and the other end of the flexible loop attached to one end of the first wedge 210. FIG. 28 depicts the living hinge 226 to be attached to the spline 3 intermediate the exposed edges of the spline 3 to accomodate a plurality of pairs of first wedges 210 used as moving means as described for the FIG. 24.

Since certain changes may be made in the above apparatus without departing from the scope of the invention herein involved, it is intended that all matter contained in the above description, as shown in the accompanying drawing, shall be interpreted in an illustrative, and not a limiting sense.

What is claimed is:

1. A binding unit for loose-leaf sheet materials or the like of the type having an open position for insertion and a closed position wherein loose-leaf materials are clamped therein comprising, in combination:

two legs, each of said legs having a free edge and a remote end spaced from said free edge, said free edges having cooperating material-engaging end portions;

a spline;

spline hinge means for coupling each of said legs to said spline in regions adjacent said remote end;

moving means for moving said free edges between said open position thereof and said closed position thereof, said cooperating material-engaging end portion clampingly securing the loose-leaf sheet materials in said closed position, said moving means comprising:

a plurality of first wedges having a first and a second end, said wedges tapering from a first preselected width at said first end to a second preselected width less than said first preselected width at said second end; and first wedge hinge means pivotally coupling one edge of one of said ends of said first wedge to said spline.

2. A binding unit as described in claim 1 and further comprising:

a plurality of latch means to keep said plurality of first wedges positioned adjacent said spline.

3. A binding unit as described in claim 2 wherein:

said latch means comprises a keeper mounted on the end of said first wedges remote from said first wedge hinge means;

a plurality of standoffs mounted on said spline remote from said free edges; and a plurality of second wedges, one of which is rigidly mounted on each of said stand-offs and disposed to be removably insertable into said keeper for the condition of said first wedge positioned adjacent said spline, said first wedge forcing apart said remote ends of said two legs, thereby forcing together said free edges of said two legs, and for the condition of said wedge removed from said keeper and said first wedge pivotally spaced apart from said spline, the user may move said remote ends of said two legs toward each other thereby spreading apart said free edges to removably insert said loose-leaf sheet materials.

4. A binding unit as described in claim 1 which further comprises:

a manipulation pad mounted on the end of each first wedge whereby the user may engage said manipulation pad to pivotally rotate said first wedge.

5. A binding unit as described in claim 1 wherein:

said first wedge hinge means comprises a flexible web.

6. A binding unit as described in claim 1 wherein:

said first wedge hinge means comprises a living hinge.

7. A binding unit as described in claim 1 wherein:

said spline hinge means comprises a flexible web.

8. A binding unit for loose-leaf sheet materials or the like of the type having an open position for insertion and a closed position wherein loose-leaf materials are clamped therein comprising, in combination:

two legs, each of said legs having a free edge and a remote end spaced from said free edge, said free edges having cooperating material-engaging end portions;

a spline;

spline hinge means for coupling each of said legs to said spline in regions adjacent said remote end;

moving means for moving said free edges between said open position thereof and said closed position thereof, said cooperating material-engaging end portion clampingly securing the loose-leaf sheet materials in said closed position, said moving means comprising:

a plurality of pairs of first wedges, each wedge having a first and a second end, said wedges tapering from a first preselected width at said first end to a second preselected width less than said first preselected width at said second end; and first wedge hinge means pivotally coupling one edge of one of said ends of each of said pair of first wedges to said spline, said hinged edges being remote from each other whereby the non-hinged ends are adjacent to each other for the condition of the first wedges positioned adjacent said spline.

9. A binding unit as described in claim 3 and further comprising:

latch means to keep said pair of first wedges positioned adjacent said spline.

10. A binding unit as described in claim 9 wherein:

said latch means comprises:

a keeper mounted on one of said adjacent ends of the pair of wedges; and a second wedge mounted on said adjacent end of the other of said pair of first wedges and positioned whereby for the condition of said pair of first wedges positioned adjacent said spline 3 said keeper is removably retainable by said second wedge.

11. A binding unit as described in claim 8 which further comprises:

a manipulation pad mounted on one of said ends of each of the pair of first wedges whereby the user may engage said manipulation pads to pivotally rotate said pair of first wedges.

12. A binding unit as described in claim 8 wherein:

said first wedge hinge means comprises a flexible web.

13. A binding unit as described in claim 8 wherein:

said first wedge hinge means comprises a living hinge.

14. A binding unit for loose-leaf sheet materials or the like of the type having an open position for insertion and a closed position wherein loose-leaf materials are clamped therein comprising, in combination:

two legs, each of said legs having a free edge and a remote end spaced from said free edge, said free edges having cooperating material-engaging end portions;

a spline rigidly attached to each of said legs in regions adjacent said remote end for the condition of the free ends of said legs in the open position thereof; and moving means for moving said free edges between said open position thereof and said closed position thereof, said cooperating material-engaging end portion clampingly securing the loose-leaf sheet materials in said closed position, said moving means comprising:

a plurality of first wedges having a first and a second end, said wedges tapering from a first preselected width at said first end to a second preselected width less than said first preselected width at said second end; and first wedge hinge means pivotally coupling one edge of one of said ends of said first wedge to said spline.

15. A binding unit as described in claim 14 and further comprising:

a plurality of latch means to keep said plurality of first wedges positioned adjacent said spline.

16. A binding unit as described in claim 15 wherein: said latch means comprises a keeper mounted on the end of each of said first wedges remote from said first wedge hinge means;

a standoff mounted on said spline remote from said free edges; and a plurality of second wedges rigidly mounted on said standoff and disposed to be removably insertable into a plurality of said keepers for the condition of each of said first wedges positioned adjacent said spline, said first wedges forcing apart said remote ends of said two legs, and deforming said spline thereby forcing together said free edges of said two legs, and for the condition of said wedges removed from said keepers and said first wedges pivotally spaced apart from said spline, said spline can return to a nominal position thereby moving said free edges to an open position thereof, the user may move said remote ends of said two legs toward each other thereby further spreading apart said free edges to removably insert said loose-leaf sheet materials.

17. A binding unit as described in claim 4 which further comprises;

a manipulation pad mounted on the end of each first wedge whereby the user may engage said manipulation pad to pivotally rotate said first wedge.

18. A binding unit as described in claim 14 wherein: said first wedge hinge means comprises a flexible web.

19. A binding unit as described in claim 14 wherein: said first wedge hinge means comprises a living hinge.

20. A binding unit for loose-leaf sheet materials or the like of the type having an open position for insertion and a closed position wherein loose-leaf materials are clamped therein comprising, in combination:

two legs, each of said legs having a free edge and a remote end spaced from said free edge, said first edges having cooperating material-engaging end portions;

a spline rigidly attached to each of said legs in regions adjacent said remote end for the condition of the free ends of said legs in the open position thereof; and moving means for moving said free edges between said open position thereof and said closed position thereof, said cooperating material-engaging end portion clampingly securing the loose-leaf sheet materials in said closed position, said moving means comprising:

a plurality of pairs of first wedges, each wedge having a first and a second end, said wedges tapering from a first preselected width at said first end to a second preselected width less than said first preselected width at said second end; and first wedge hinge means pivotally coupling one edge of one of said ends of each of said pair of first wedges to said spline, said hinged edges being remote from each other whereby the non-hinged ends are adjacent to each other for the condition of the first wedges positioned adjacent said spline.

21. A binding unit as described in claim 20 and further comprising:

latch means to keep said pair of first wedges positioned adjacent said spline.

22. A binding unit as described in claim 21 wherein: said latch means comprises:

a keeper mounted on one of said adjacent ends of the pair of wedges; and a second wedge mounted on said adjacent end of the other of said pair of first wedges and positioned whereby for the condition of said pair of first wedges positioned adjacent said spline 3 said keeper is removably retainable by said second wedge.

23. A binding unit as described in claim 20 which further comprises:

a manipulation pad mounted on one of said ends of each of the pair of first wedges whereby the user may engage said manipulation pads to pivotally rotate said pair of first wedges.

24. A binding unit as described in claim 20 wherein: said first wedge hinge means comprises a flexible web.

25. A binding unit as described in claim 20 wherein: said first wedge hinge means comprises a living hinge.

* * * * *